US007032812B2

(12) United States Patent
Ostini

(10) Patent No.: US 7,032,812 B2
(45) Date of Patent: Apr. 25, 2006

(54) QUICK-EXTRACTION PUNCH-HOLDER ADAPTER FOR CONVERTING PUNCHING MACHINES FROM A SINGLE-PUNCH TO A MULTIPLE-PUNCH CONFIGURATION

(75) Inventor: Giorgio Ostini, Palazzo Laura (CH)

(73) Assignee: Euromac S.p.A., Modena (IT)

( * ) Notice: Subject to any disclaimer, the term of this patent is extended or adjusted under 35 U.S.C. 154(b) by 0 days.

(21) Appl. No.: 10/118,475

(22) Filed: Apr. 8, 2002

(65) Prior Publication Data

US 2002/0162440 A1 Nov. 7, 2002

Related U.S. Application Data

(63) Continuation-in-part of application No. 09/843,988, filed on Apr. 27, 2001, now abandoned.

(51) Int. Cl.
*B26F 1/14* (2006.01)
*B26D 5/08* (2006.01)

(52) U.S. Cl. ..... 234/43; 83/549; 83/552; 83/564; 83/691

(58) Field of Classification Search ..... 83/527, 83/549, 552, 564, 684, 685, 690, 698.91, 83/688, 657, 691, 954; 234/38–43
See application file for complete search history.

(56) References Cited

U.S. PATENT DOCUMENTS 4,341,137 A * 7/1982 Leitch et al. ..... 83/552
4,375,774 A 3/1983 Wilson et al.
4,623,089 A * 11/1986 Scott ..... 83/698.91
4,898,056 A * 2/1990 Grobb et al. ..... 83/690
4,929,276 A 5/1990 Chun et al.
4,998,958 A 3/1991 Chun et al.
5,012,712 A * 5/1991 Nordquist ..... 83/549
5,042,352 A * 8/1991 Lux ..... 83/690
5,048,385 A 9/1991 Eckert et al.
5,133,237 A * 7/1992 Daffe ..... 83/698.91
5,176,057 A * 1/1993 Chun et al. ..... 83/698.91
5,345,861 A * 9/1994 Brewer et al. ..... 83/527
5,419,225 A * 5/1995 Fujita ..... 83/698.91

(Continued)

FOREIGN PATENT DOCUMENTS

EP 0 563 444 A1 10/1993

(Continued)

*Primary Examiner*—Allan N. Shoap
*Assistant Examiner*—Jason Prone
(74) *Attorney, Agent, or Firm*—Wolf Greenfield & Sacks PC

(57) ABSTRACT

A punching machine comprising at least one punching head including a support body having a first end delimiting a peripheral shoulder, a second end, and at least two parallel seats being angularly spaced from one another and extending through said support body from said first end to said second end; a punching tool holder slibably mounted in at least one of said seats; a multiplicity of removable resilient means angularly spaced from one another, each having a first end resting on said peripheral shoulder and a second end facing away from said peripheral shoulder; an annular cap member arranged in front and spaced from said peripheral shoulder and designed to abut against said second end of said resilient means; a rotor member mounted for rotation on said annular cap member and having an inner face thereof facing towards said punching tool holder; a sliding member projecting from said inner face and arranged to slide onto said punching tool holder when said rotor member rotates; and driving means designed to stepwise drive said rotor member, whereby locating said sliding member onto a pre-selected punching tool holder.

14 Claims, 4 Drawing Sheets

U.S. PATENT DOCUMENTS

| | | | | |
|---|---|---|---|---|
| 5,615,471 | A | 4/1997 | Perazzolo | |
| 5,813,301 | A * | 9/1998 | Fujita | 83/698.91 |
| 5,848,563 | A | 12/1998 | Saito | |
| 5,934,165 | A | 8/1999 | Chatham | |
| 5,993,090 | A | 11/1999 | Straka et al. | |
| 6,074,330 | A | 6/2000 | Ostini | |
| 6,279,445 | B1 * | 8/2001 | Rosene et al. | 83/698.91 |
| 6,463,839 | B1 * | 10/2002 | Ohtsuka et al. | 83/698.91 |
| 6,675,688 | B1 * | 1/2004 | Ostini | 83/549 |
| 2001/0039867 | A1 * | 11/2001 | Ostini | 83/698.91 |

FOREIGN PATENT DOCUMENTS

| | | | |
|---|---|---|---|
| EP | 0 727 263 | A1 | 8/1996 |
| EP | 0 875 310 | A1 * | 11/1998 |
| EP | 1 050 350 | A1 * | 11/2000 |
| GB | 2 324 755 | A1 | 11/1998 |
| GB | 2 360 727 | A * | 10/2001 |

* cited by examiner

QUICK-EXTRACTION PUNCH-HOLDER ADAPTER FOR CONVERTING PUNCHING MACHINES FROM A SINGLE-PUNCH TO A MULTIPLE-PUNCH CONFIGURATION

This is a continuation-in-part of Application No. 09/843,988, filed Apr. 27, 2001, now abandoned, the disclosure of which is expressly incorporated herein by reference.

BACKGROUND OF THE INVENTION

The present invention relates to a quick-extraction multiple punching head for converting punching machines from a single-punch to a multiple-punch configuration.

It is well-known that punching machines employed to machine metal plates use bodies, known as punch-holders, for accommodating the punches. The punches are located within the punch holder below the hammer, and, when struck by the hammer, the punches move over a stroke of a preset extent, allowing the metal plate to be worked.

Such punch-holders generally consist of a cylindrical body formed with a through seat accommodating the punch that is used for a given punching operation, so as to accommodate only one punch at a time. A horizontal disk-shaped member is mounted above the cylindrical body, such that it can move in a vertical direction, and supports on its lower face a mechanical coupling for engaging the head of the punch. Two helical pressure springs are located between the lower face of the disk and the upper face of the body of the punch-holder, and are arranged to effect a drawing upwards of the disk after each punching operation to extract the punch from the material being punched.

With this arrangement, when a given punching process has to be modified, it is necessary to remove the punch and replace it with another one suitable for performing the new desired punching process. Moreover, it should be noted that punches wear out over time and, in order to be used for longer periods, they are subjected to grinding or sharpening operations which cause variations in their overall useful length. All of this results in variations in the stroke that the hammer must perform to execute a complete punching operation. A variation of a few millimeters can be compensated by adjusting the stroke of the hammer.

The above-described prior art suffers from some drawbacks. A first drawback is the fact that replacement of a punch is relatively complicated and time-consuming.

A second drawback is that the extraction force exerted by the return springs is rather limited. Thus, it may happen that after an active descent of the punch, the punch is held jammed in a just perforated metal plate, consequently requiring that an operator manually release the punch from the metal plate by using tools, resulting in a significant waste of time and the necessity of stopping the punching machine.

A third drawback is that, after a limited number of grinding operations aimed at restoring their lower surfaces, the punches must be replaced because their shortening can no longer be compensated for by adjusting the stroke of the hammer.

GB 2,324,755 A discloses a device for converting punching machines from manual to quick and automatic, comprising a stator element inserted in a seat provided in the machine and supporting a plurality of punches provided peripherally, and a rotor element coaxial with the stator element provided with pusher means, for selection of the punch by gradual rotations thereof. The rotor element, suitable for being moved vertically by a pre-set extent, is guided by stem-like means mounted coaxially inside the stator. Punches are withdrawn by the elongation of a helical spring fitted onto the stem-like means. The force exerted by the spring is constant, regardless of the composition of the plate to be punched and of the plate's resistance thereof to punching.

U.S. Pat. No. 4,375,774 to Wilson discloses a single punch assembly comprising a punch guide, a punch head assembly, and a punch driver. The punch head assembly and the punch driver are threadably engaged with each other and allow adjustment of the punch length. The diameter of the punch head is much greater than that of the shank, and this makes the assembly cumbersome to use. Another drawback of this invention is the fact that the adjustment means are only suitable for application to single punching machines, as the threading engages components whose diameter is much greater than that of the punch itself.

SUMMARY OF THE INVENTION

A first aim of the present invention is to obviate the above-noted drawbacks of the punching machines of the prior art by providing a quick-extraction multiple punching head for converting a punching machine from a single-punch to a multiple-punch configuration. The multiple punching head of the present invention makes it possible to have a plurality of punches available below the hammer, thus eliminating the need to systematically replace the punch every time a punching process changes, and allows removal of the punch from the punched material in a highly reliable way and with no jamming.

A further aim of the present invention is to provide a multiple punching head that makes it possible to quickly adjust the length of single punches to compensate for wearing of the punches and for variations in length of the punches resulting from grinding operations repeated over time on the punch heads.

A further aim of the present invention is to provide a quick-extraction multiple punching head. In this manner, unlike the prior art punches, the punch can be withdrawn at a speed suitable for the specific material making up the plate to be punched, thereby reducing the risk of producing punches affected by imperfections and defects such as burrs. The speed at which the punch returns can be selected for a given type of material; for example, a slow withdrawal can be selected for a punch made in a soft material.

These and other objects which will become better apparent hereinafter are achieved by a punching machine comprising: at least one punching head including a support body having a first end delimiting a peripheral shoulder, a second end, and at least two parallel seats being angularly spaced from one another and extending through the support body from the first end to the second end; a punch slidably mounted in at least one of the seats; a multiplicity of removable resilient means angularly spaced from one another, each having a first end resting on the peripheral shoulder and a second end facing away from the peripheral shoulder; an annular cap member arranged in front and spaced from the peripheral shoulder and designed to abut against the second end of the resilient means; a rotor member mounted for rotation on the annular cap member and having an inner face thereof facing towards the punch; a sliding member projecting from the inner face and arranged to slide onto the punch when the rotor member rotates; and driving means designed to stepwise drive the rotor member, whereby locating the sliding member onto a pre-selected punch.

BRIEF DESCRIPTION OF THE DRAWINGS

Further features and advantages will become better apparent from the following detailed description of a preferred embodiment of a quick-extraction multiple punching head for converting punching machines from a single-punch to a multiple-punch configuration, illustrated only by way of non-limiting example in the accompanying drawings, wherein.

DETAILED DESCRIPTION

Figure 1:
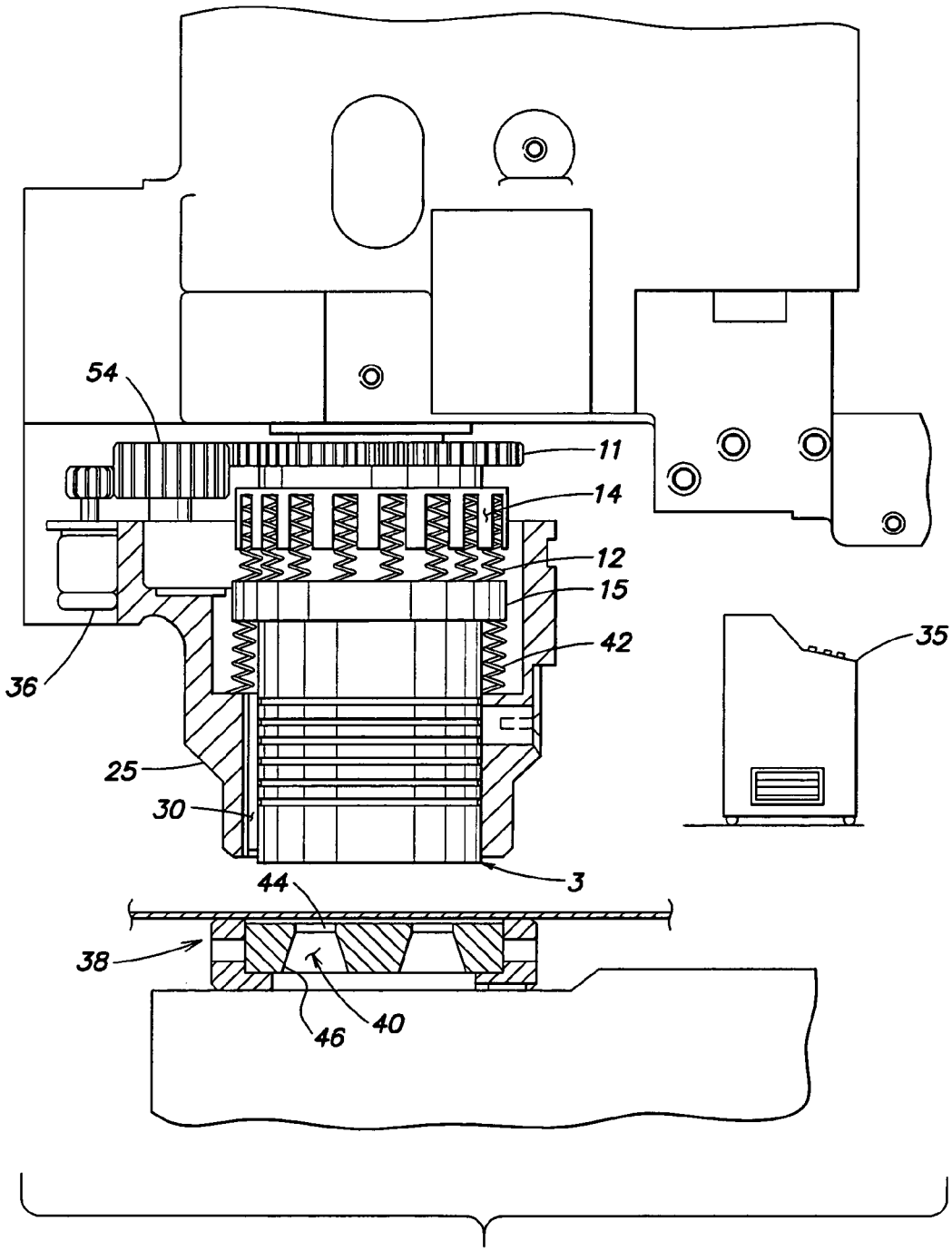
FIG. 1 is a side view of the punching head according to the invention assembled in a suitable device.

With reference to the above FIGS. 1 to 6, numeral 1 designates a quick-extraction multiple punching head for converting a punching machine from a single-punch to a multiple-punch configuration. Punching head 1 comprises a cylindrical body 3 which is provided on its outer surface with a rib 30. The cylindrical body 3 is located in an outer casing 25. The outer casing 25 is provided with a slot adapted to receive the rib 30 for preventing rotation of the cylindrical body 3. The punching head is formed with a plurality of seats 4, e.g., four in number, each being designed to locate the axis of a respective punch 2 parallel to the axis of the cylindrical body 3.

At one end of the cylindrical body 3 there is provided a rotatably fitted selection group 5 which is provided on its lower face with a pusher 6 in contact with the head 2*c* of a respective punch 2. As shown in FIG. 1, the selection group 5 can be conveniently coupled to a motor 36 controlled by suitable control unit 35 which is arranged to cause angularly controlled rotation thereof through transmission gearwheels 54, the motor 36 being supported by a turret of the punching machine.

Resilient means 7, which can be pressure loaded, are located between an annular cap member 113 and the cylindrical body 3 and are arranged angularly spaced along a circumference to contrast the active punching strokes of each respective punch 2 and to cause it to effect its return stroke.

Each punch 2 advantageously comprises two coaxial cylindrical sections, respectively an upper section 2*a* and a lower section 2*b*, which are longitudinally connected to one another through fine-pitch screw thread means 8 for adjusting the overall lengths of the punches.

A carousel 38 is provided underneath the plate to be punched, the carousel 38 having a number of seats 40 formed therein for receiving the shaped punch tip 2*d* at the end of the punching stroke. Conveniently, the carousel seats 40 have a section comprising a cylindrically shaped top portion 44 and a frusto-conically shaped bottom portion 46, provided in order to contain the waste material produced by the punching operation.

Locking means 9 for locking the rotation of the punches 2 about their axis inside the seats 4 are provided between the punches and their respective seats 4.

The selection group 5 consists of a disk-shaped portion 10 which is coaxially supported at one end of the cylindrical body 3 and which has on its lower face the pusher 6 and, in its peripheral region, at least one gearwheel 11 for coupling with the motor 36, which is controlled by means of control unit 35 which includes, for example, a keyboard. The selection group 5 further includes a sleeve 50 that is constructed to engage punch 2 by means of lip 55.

The resilient means 7 preferably comprises a plurality of helical springs 12 being removably fitted on spring guide pins 12*a* between a circumferential extension 13 of annular cap member 113 and one end of the cylindrical body 3. Circumferential extension 13 is also provided with an outer vertical side guiding and retention wall 14 and an outer shoulder 15, which also circumferentially extends from said one end of the cylindrical body 3.

Said The outer side wall 14 is provided with a plurality of slots 14*a*, each formed at a respective helical spring so as to act with the respective spring guide pins 12*a* as a guide for the respective springs.

The helical springs 12, spring guide pins 12*a*, and slots range between 3 and 30 in number, and are preferably even in number, so as to not affect the overall balance of the device when some springs 12 are removed. Helical springs 12 may be easily removed or added by the operator of the punching machine so as to vary the return stroke in order to accommodate material to be punched that is of different thicknesses or compositions. For example, more springs may be used where the material is thicker, harder, or stiffer, while fewer springs may be used for material that is thinner, softer, or more flexible.

Figure 2:
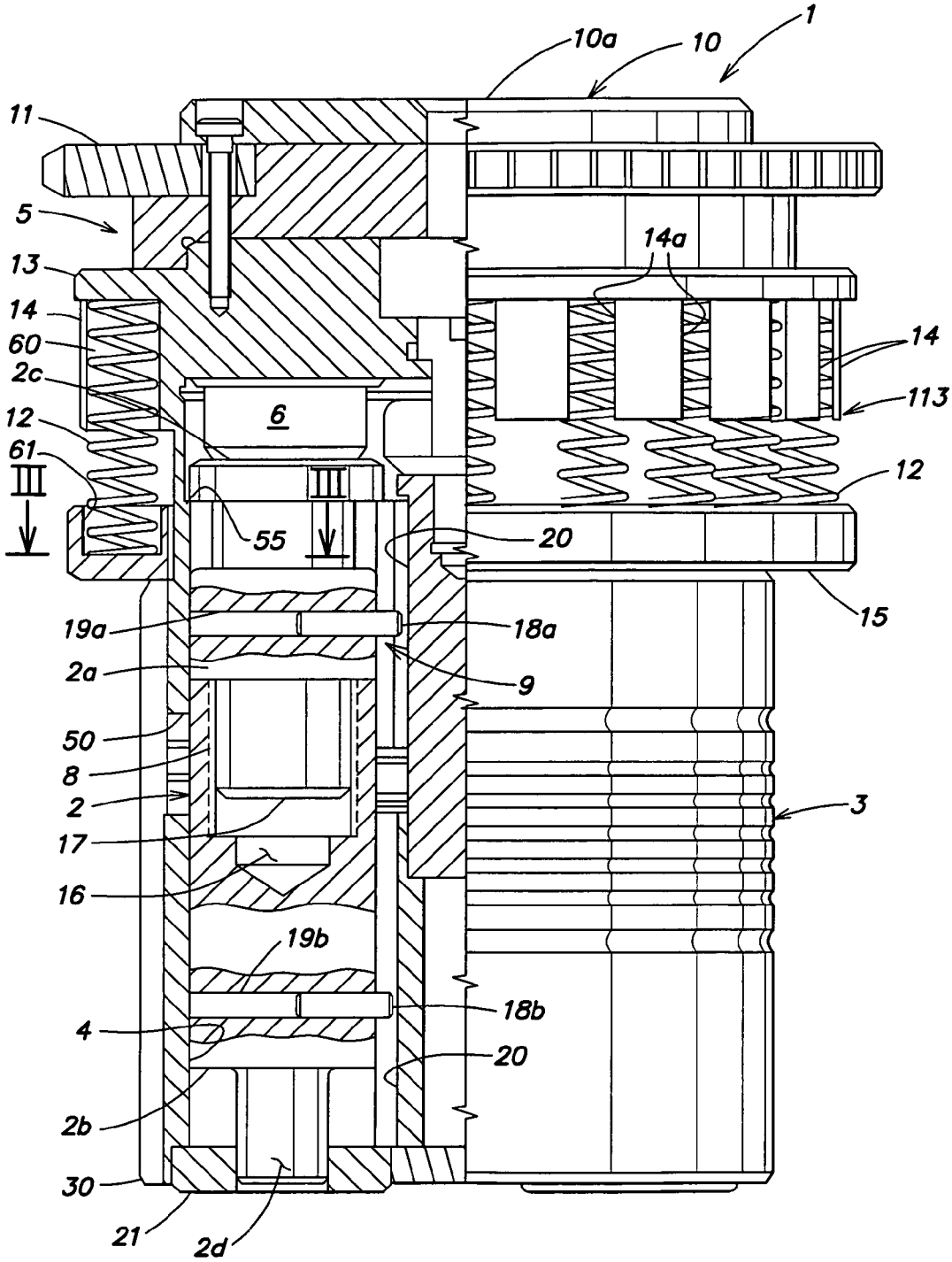
FIG. 2 is a partial sectional view taken along a vertical plane of a multiple punching head according to the invention.
Figure 3:
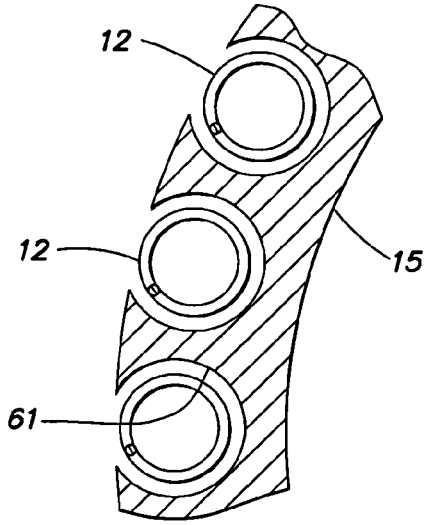
FIG. 3 is a partial cross-section taken along the line III—III of FIG. 2.
Figure 4:
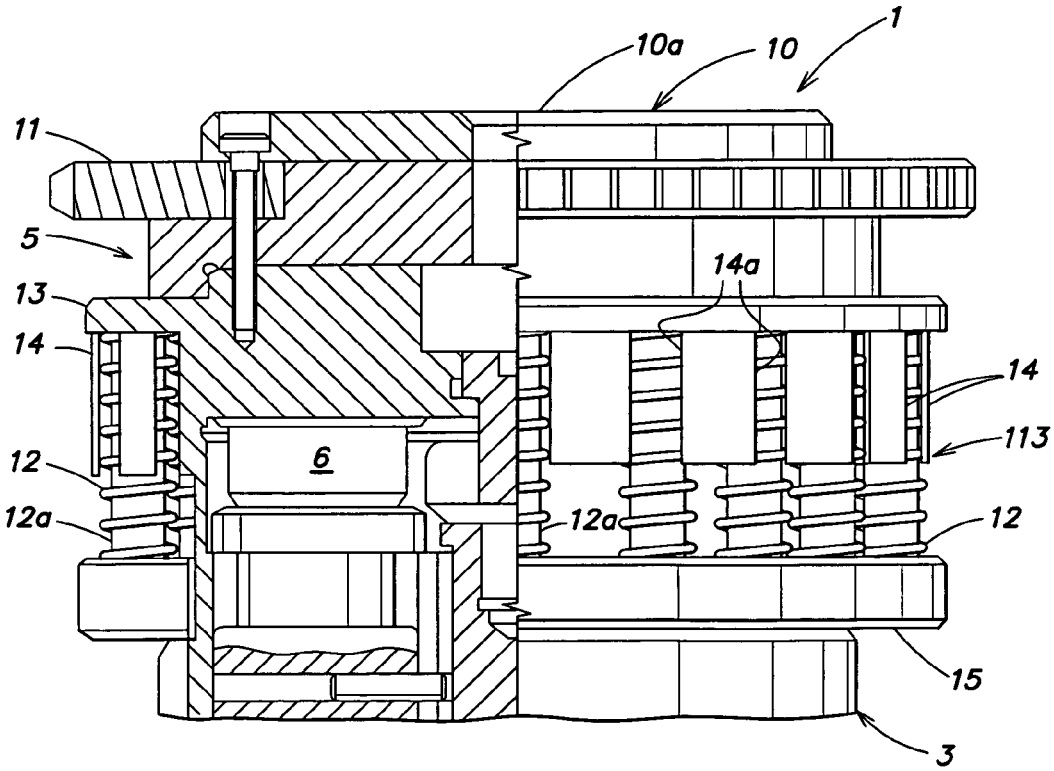
FIG. 4 is a partial sectional view of a modification of a punching head according to the invention.
Figure 5:
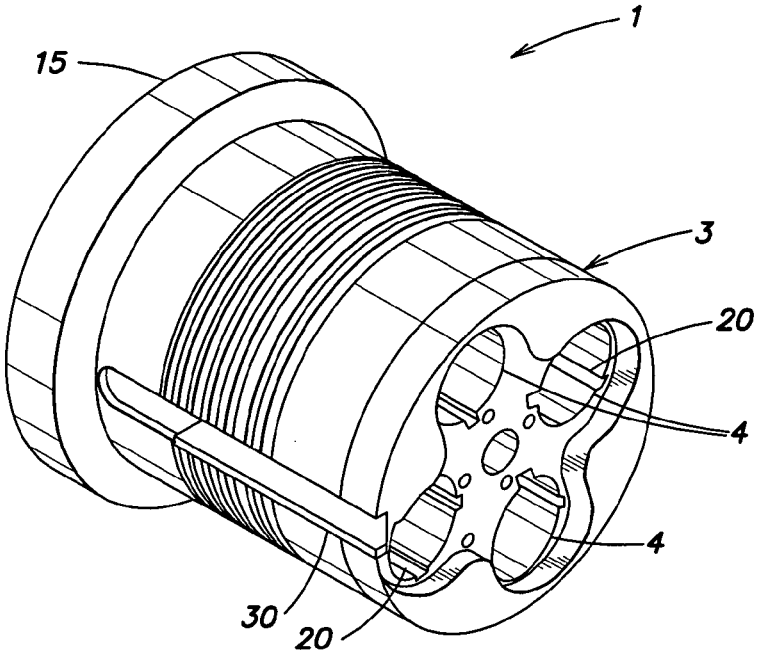
FIG. 5 is a reduced scale perspective view of a punching head according to the invention.
Figure 6:
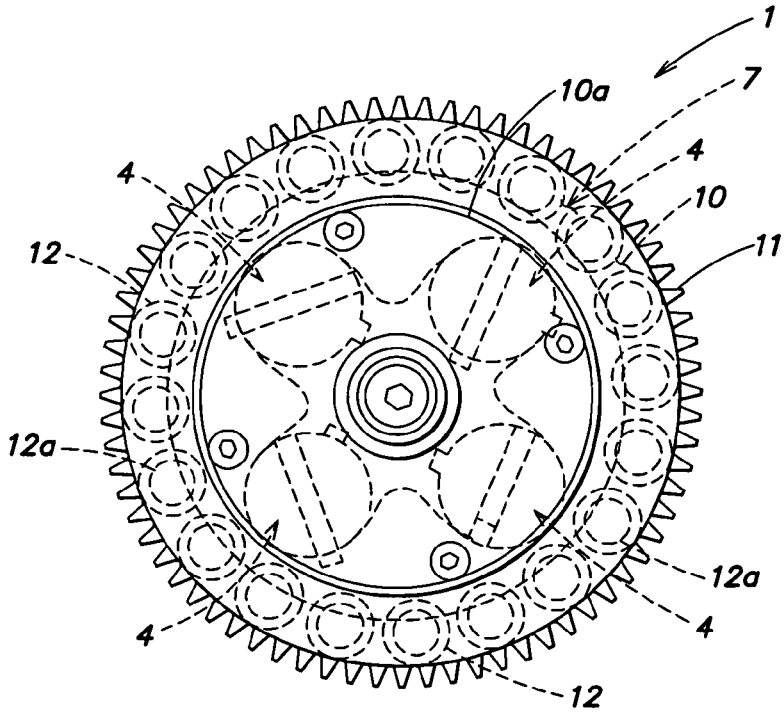
FIG. 6 is a cross section on an enlarged scale of a punching head of the present invention.

According to a further embodiment of the present invention, and with particular reference to FIGS. 2 and 3, in lieu of the spring guide pins 12*a*, the circumferential extension 13 has a thickness within which a number of further seats 61 are formed for removable seating of the respective resilient means 7. The further seats 61 are provided with respective slots for the purpose of lubrication and easy removal of the resilient means 7.

Preferably, during the whole punching operation, the resilient means 7 are longer than their respective further seats 61, so that a portion of each resilient means 7 is not lodged in its respective further seat 61, ensuring easier removal thereof, and so that the seat does not obstruct the increase in diameter that the resilient means 7 is likely to be subjected to under compression. Moreover, the further seats 61 are arranged such that there is enough clearance to avoid friction between the resilient means 7 and the inner walls 60 of their respective further seats 61.

The cylindrical body 3 is stabilized in the outer casing 25 by a number of stabilizing helical springs 42, for example, two of them, that are removably located between the outer shoulder 15 and the outer casing 25.

The disk 10 is mounted on the cylindrical body 3 so that it can move coaxially to it, with a useful stroke whose extent can be preset according to the type of punching to be performed and the thickness of the metal plate to be punched. Resilient means 7 can be easily removed by simple removal of gearwheel 11 and disk shaped portion 10.

The fine-pitch screw thread means 8 comprises a hollow cylindrical seat 16 which is formed in the lower section 2*b* of each punch 2. Each seat 16 is open upwards and is provided with an internal thread. A respective cylindrical threaded pin 17 can be snugly screwed into each seat 16 and is rigid and coaxial with the upper section 2*a* of its respective punch 2.

The locking means 9 comprises at least two pins 18*a* and 18*b* transversely inserted into respective slots 19*a* and 19*b* which are respectively formed in the upper section 2*a* and the lower section 2*b* of each punch 2. The pins 18*a* and 18*b* are vertically aligned and, by protruding from the sides of the sections 2*a* and 2*b*, they engage with respective slots 20 which are formed longitudinally in each seat 4 so as to prevent the punches 2 from rotating about their own longitudinal axis. More specifically, three slots 20 angularly spaced through 120° from one another are provided for each hollow seat 4.

As known, each one of the seats 4 is closed at the bottom thereof by a diaphragm 21 arranged to guide the shaped punch tip 2*d* of its respective punch 2.

Operation of the above described punching head is as follows. The punching head 1 is inserted snugly in a suitable seat in the upper turret of a punching machine in which a conventional single punch-holder is normally fitted.

A motor 36 provided with a transmission sprocket which meshes with the gearwheel 11 of the disk 10 is also supported on the turret. Punches 2 are arranged in the cylindrical body 3, each punch being arranged inside a respective seat 4.

If the punches 2 are new, the upper section 2*a* and the lower section 2*b* of each are fully screwed together, i.e., the pin 17 is fully screwed into the seat 16, whereas if a punch 2 has been subjected beforehand to wear or a grinding operation at its shaped punch tip 2*d*, the upper portion 2*a* is turned by a present number of turns so as to unscrew it with respect to the lower portion 2*b*, thereby essentially increasing the total length of the punch 2 until it reaches its original length.

When all the punches 2 are inserted into their respective seats 4, the transverse pins 18*a* and 18*b* slide into the slots 20 and thus snugly engage with them to prevent the punches 2 from rotating about their own longitudinal axis. The motor 36 then causes the disk 10 to effect an angularly controlled rotation until the pusher 6 reaches the punch 2 to be selected. The selection is preset by an operator acting on the control unit 35 and is performed by means of an electronic control logic (not shown in the drawings) which automatically controls the entire punching machine.

Correspondingly, a female die holder (partially shown around the carousel 38) of any suitable type is inserted flush with the supporting surface of a bedplate (partially shown on carousel 38) on which the metal plate to be punched rests; the female die being vertically aligned with a punch 2.

A hammer (not shown in the drawings) then performs an active stroke by striking the upper face 10*a* of the disk 10 which, by sliding vertically with respect to the cylindrical body 3, moves the pusher 6 a preset extent which, in turn, pushes a pre-selected punch 2 a preset extent towards the metal plate to be punched, while at the same time compressing the springs 12. The hammer then rises and the set of springs 12 extends, forcibly lifting pusher 6, which lifts disk 10. Disk 10 lifts sleeve 50, and in particular lip 55, which extracts the punch from the metal plate.

Thus, the above-described invention is suitable for achieving the intended aim and objects, i.e., it makes it possible to compensate for changing lengths of the punches after wear and/or grinding thereof, to have a multiplicity of punches available with no need for resorting at each change in punching, to easily replace a punch, to safely extract the punch after each active punching step, and to avoiding jamming of the punching machine. The invention thus conceived is susceptible to numerous modifications and variations within the scope of the appended claims.

All the details may further be replaced with other technically equivalent ones.

The invention claimed is:

1. A punching machine comprising:

at least one punching head including a cylindrical body having a first end, a second end, and at least two parallel seats being angularly spaced from one another and extending through said cylindrical body from said first end to said second end;

a punch slidably mounted in at least one of said seats;

a multiplicity of removable resilient means angularly spaced from one another, each resting on said first end and extending away from said first end;

an annular cap member arranged in front and spaced from said first end and designed to abut against said resilient means;

a rotor member mounted for rotation on said annular cap member and having an inner face facing said punch;

a sliding member projecting from said inner face and arranged to slide onto said punch when said rotor member rotates; and driving means designed to stepwise drive said rotor member, whereby locating said sliding member onto a pre-selected punch, said first end comprising a peripheral shoulder projecting outwardly from said cylindrical body so that said resilient means are located substantially externally of said cylindrical body; and wherein said annular cap member is provided with an outer vertical side guiding and retention wall protruding towards said peripheral shoulder.

2. A punching machine as claimed in claim 1, wherein said punch comprises a tip and a head, the tip being in threadable engagement and axial alignment with the head.

3. A punching machine as claimed in claim 2, wherein said seats in said cylindrical body are formed with at least one longitudinal guide means.

4. A punching machine as claimed in claim 3, wherein said guide means is a slot.

5. A punching machine as claimed in claim 1, wherein said outer vertical side guiding and retention wall is formed with slots for receiving said resilient means.

6. A punching machine as claimed in claim 1, wherein said annular cap member is formed with at least two seats for removably locating said resilient means.

7. A punching machine as claimed in claim 6, wherein said seats formed in said annular cap member are outwardly provided with slots.

8. A punching machine as claimed in claim 1, wherein said seats further comprise at least one locking means, and said punch is formed with engaging means arranged to engage said locking means for preventing rotation of said punch with respect to said cylindrical body.

9. A punching machine as claimed in claim 1, wherein each of said resilient means is fitted onto a respective guide pin.

10. A punching machine as claimed in claim 1, wherein said resilient means are angularly spaced on said peripheral shoulder.

11. A punching machine as claimed in claim 1, wherein said outer vertical side wall is provided with a plurality of slots formed at each of said resilient means.

12. A punching machine as claimed in claim 1, wherein said resilient means are helical springs.

13. A punching machine as claimed in claim 1, further comprising an outer casing arranged to locate said cylindrical body and having retention means designed to prevent rotation of said cylindrical body therein.

14. A punching machine as claimed in claim 1, wherein said driving means comprises a motor, a transmission between said motor and said rotor member, and a control unit to control said motor according to a predetermined program.

* * * * *